US005900605A

United States Patent [19]

Uno

[11] Patent Number: 5,900,605

[45] Date of Patent: May 4, 1999

[54] CONSTRUCTION OF ROTARY TYPE SHEET COUNTER DISC

[76] Inventor: Tadao Uno, 1-84, Matsugaoka 1-chome, Chigasaki-shi, Kanagawa-ken, Japan

[21] Appl. No.: 08/798,923

[22] Filed: Feb. 12, 1997

[30] Foreign Application Priority Data

Dec. 6, 1996 [JP] Japan ..... 8-327193

[51] Int. Cl.[6] ..... G06M 1/00

[52] U.S. Cl. ..... 235/91 R

[58] Field of Search ..... 235/91 R

[56] References Cited

U.S. PATENT DOCUMENTS

| | | | |
|---|---|---|---|
| 3,822,031 | 7/1974 | Sterling et al. | 221/10 |
| 4,114,804 | 9/1978 | Jones et al. | 235/476 |
| 4,227,073 | 10/1980 | Miyagawa | 235/92 SB |
| 4,383,683 | 5/1983 | Rathert | 270/58 |
| 5,003,755 | 4/1991 | Draghetti | 53/466 |
| 5,107,991 | 4/1992 | Nichols et al. | 209/700 |
| 5,180,156 | 1/1993 | Matsui et al. | 271/103 |
| 5,431,274 | 7/1995 | Schaupp | 198/474.1 |
| 5,454,524 | 10/1995 | Bullivant et al. | 241/242 |
| 5,494,399 | 2/1996 | Pearce | 414/788.4 |
| 5,653,576 | 8/1997 | Pearce | 414/797.7 |

FOREIGN PATENT DOCUMENTS 59-1661 1/1984 Japan .

*Primary Examiner*—Anita Pellman Gross
*Assistant Examiner*—Daniel Sherr
*Attorney, Agent, or Firm*—Wenderoth, Lind & Ponack, L.L.P.

[57] ABSTRACT

A rotary type sheet counter disc gradually counts corner portions of stacked-up sheets from the top sheet to the bottom sheet. The sheet counter disc includes an upper disc and a lower disc on which the upper disc is placed, the lower disc having a plurality of sheet suction fins equally spacedly arranged on a peripheral edge portion thereof. The sheet suction fins each have a sheet suction port which is open at a lower surface thereof, and the lower disc has a plurality of sheet loosening claws projecting in a rotating direction of the sheet counter disc from leading ends of the sheet suction fins. A plurality of sheet introduction slits are formed between upper surfaces of the sheet loosening claws and a lower surface of a portion of the upper disc which covers the sheet loosening claws. The sheet introduction slits each have a sheet introduction port opening at a distal end portion of each sheet loosening claw, and the upper disc has a plurality of sheet outlet slits equally spacedly arranged on a peripheral edge portion thereof. The sheet outlet slits each have a sheet outlet port communicating with each sheet introduction slit and opening at an upper surface of the upper disc, and the sheet suction fins each draw an upper surface of each stacked-up sheet thereto by suction. Each of the sheet loosening claws is inserted under and takes up a lower surface of a corner portion of each sheet drawn by suction, so as to introduce the same into each sheet introduction slit through each sheet introduction port. The sheet corner portion introduced into the sheet introduction sheet is introduced into the sheet outlet slit and taken up onto the upper surface of the upper disc through the sheet outlet port.

5 Claims, 8 Drawing Sheets

CONSTRUCTION OF ROTARY TYPE SHEET COUNTER DISC

BACKGROUND OF THE INVENTION

Field of the Invention

This invention relates to a rotary type sheet counter disc and more particularly to a construction of a rotary type sheet counter disc for taking up the corner portions of stacked-up sheets from the top sheet to the bottom sheet for the purposes of counting a predetermined number of the sheets and separating them from the rest.

FIGS. 3 and 4 of Japanese Patent Publication No. 1661/1984 illustrate a sheet counter comprising a sucker for sucking an upper surface of a corner portion of each stacked-up sheet from the top sheet to the bottom sheet, a separate bar for taking up the sheet sucked by the sucker, and a motor for controlling them.

The sucker constituting the sheet counter repeats a vertical whirling action at a constant cycle and takes up a sheet each time the whirling action is made. On the other hand, the separator rotates around the periphery of the sucker in one direction and takes up and supports the lower surface of the sheet sucked by the sucker during the rotating process of the separator. By repeating the above motion, a required number of sheets are counted and separated from the rest.

The above conventional sheet counter has the following shortcomings. The sheet counter sucks up a comer portion of a sheet each time the sucker performs a whirling motion. Therefore, the speed for sucking up the stacked sheets is limited and difficult to be improved. This means that the ever-increasing requirement for higher speed is difficult to be fulfilled. If the whirling speed is overly increased, there is a possibility that each stacked-up sheet cannot be sucked in a reliable manner.

The present invention has been accomplished in view of the above situation.

SUMMARY OF THE INVENTION

It is, therefore, an object of the present invention to provide a construction of a rotary type sheet counter disc capable of increasing the counting speed of stacked-up sheets.

In order to achieve the above object, there is essentially provided a construction of a rotary type sheet counter disc for gradually counting comer portions of stacked-up sheets from the top sheet to the bottom sheet. The sheet counter disc comprises an upper disc and a lower disc on which the upper disc is placed, the lower disc having a plurality of sheet suction fins equally spacedly arranged on a peripheral edge portion thereof, and the sheet suction fins each having a sheet suction port which is open at a lower surface thereof. The lower disc has a plurality of sheet loosening claws projecting in a rotating direction of the sheet counter disc from leading ends of the sheet suction fins, and a plurality of sheet introduction slits are formed between upper surfaces of the sheet loosening claws and a lower surface of a portion of the upper disc which covers the sheet loosening claws. The sheet introduction slits each have a sheet introduction port opening at a distal end portion of each sheet loosening claw, and the upper disc has a plurality of sheet outlet slits equally spacedly arranged on a peripheral edge portion thereof. The sheet outlet slits each have a sheet outlet port communicating with each sheet introduction slit and opening at an upper surface of the upper disc, and the sheet suction fins each draw an upper surface of each stacked-up sheet thereto by suction. Each of the sheet loosening claws is inserted under and takes up a lower surface of a corner portion of each such sucked-up sheet so as to introduce the same into each sheet introduction slit through each sheet introduction port. The sheet corner portion introduced into the sheet introduction sheet is introduced into the sheet outlet slit and is taken up onto the upper surface of the upper disc through the sheet outlet port.

The sheet counter disc may preferably be supported such that the sheet counter disc is capable of rotation while being lowered in a state that the sheet counter disc is loaded on the upper surface of the corner portion of the stacked-up sheets.

It is preferred that the sheet introduction slits or the sheet outlet slits are each provided in an inner surface thereof with a sheet suction port for generating a sheet counting signal.

It is also preferred that the sheet suction fins are each provided in a lower surface thereof with a sheet releasing groove extending in the rotating direction, an end opening portion of the sheet releasing groove is faced with a distal end of the sheet loosening claw, and a plurality of the sheet suction ports are open at an inner bottom surface of the sheet releasing groove.

It is also preferred that the mutually communicating sheet introduction slits and sheet outlet slits extend in an opposite direction with respect to the rotating direction of the sheet counter disc at an upwardly inclining angle.

The above and other objects, characteristic features and advantages of the present invention will become more apparent to those skilled in the art by the following description of the preferred embodiment of the invention, as illustrated in the accompanying drawings.

DETAILED DESCRIPTION OF THE EMBODIMENT

One preferred embodiment of the present invention will now be described with reference to FIGS. 1 through 13 of the accompanying drawings.

The present invention is embodied in the form of a rotary type sheet counter disc for repeatedly taking up, while rotating at a high speed, the corner portions of stacked-up sheets from the top sheet to the bottom sheet for the purposes of counting a predetermined number of the sheets and separating them from the rest.

Figure 1:
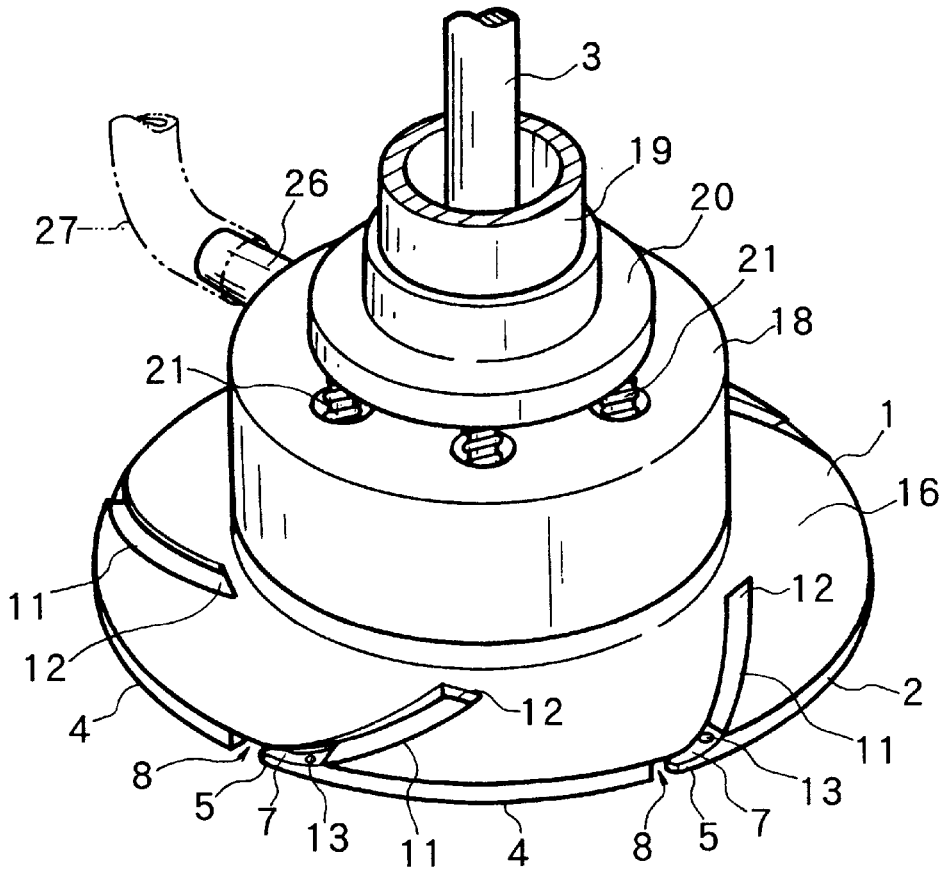
FIG. 1 is a perspective view schematically showing an outer appearance of a construction of a rotary type sheet counter disc.
Figure 4:
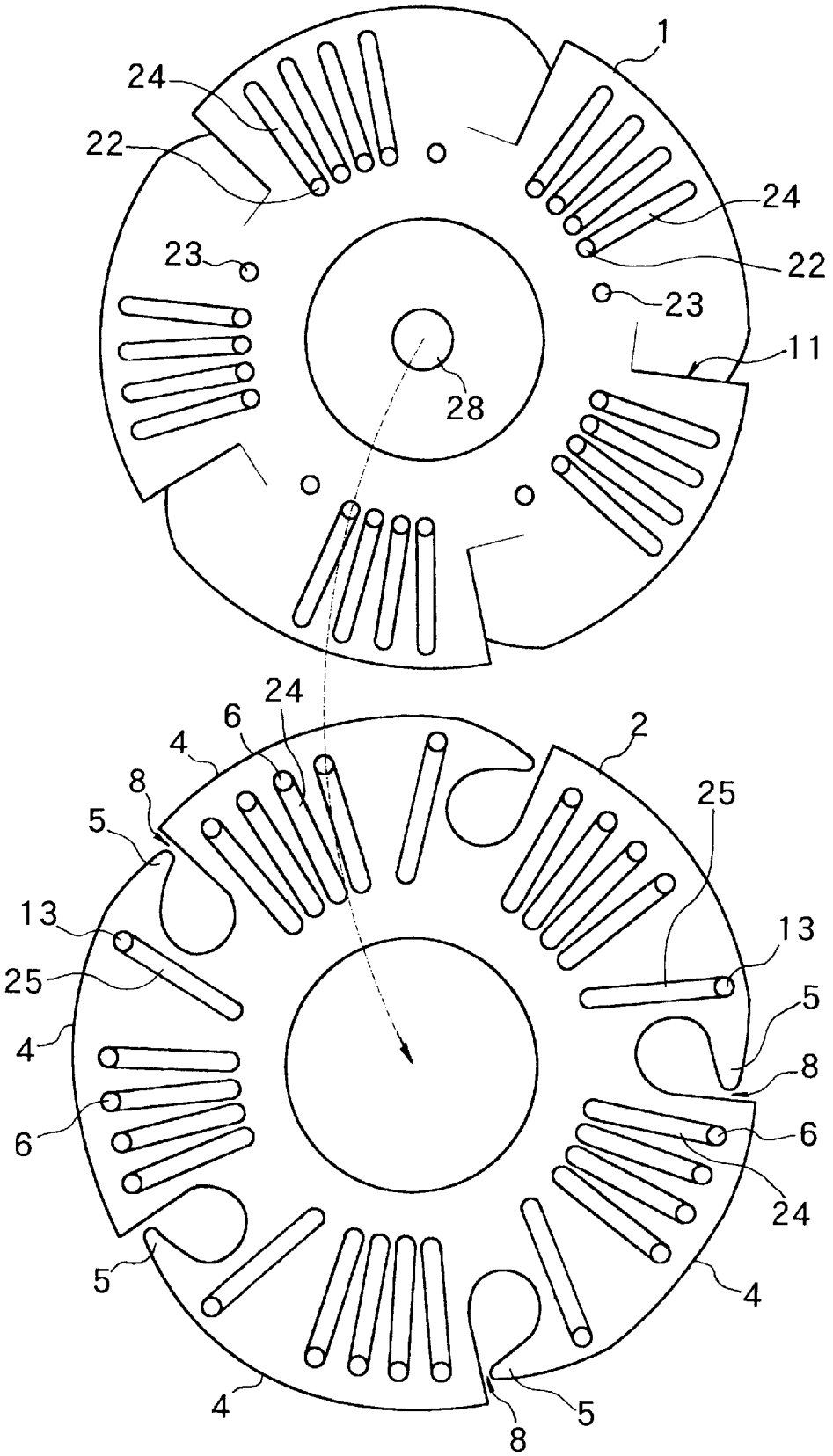
FIG. 4 is a plan view showing overlapping surfaces of an upper and a lower disc which constitute the sheet counter disc.
Figure 5:
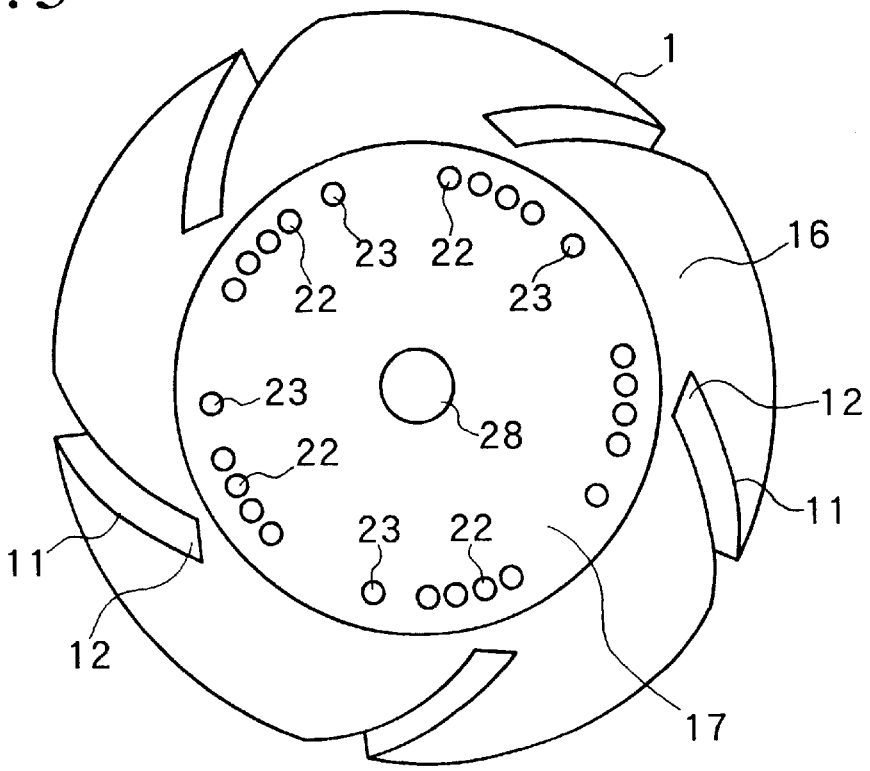
FIG. 5 is a plan view showing an upper surface of the upper disc.
Figure 6:
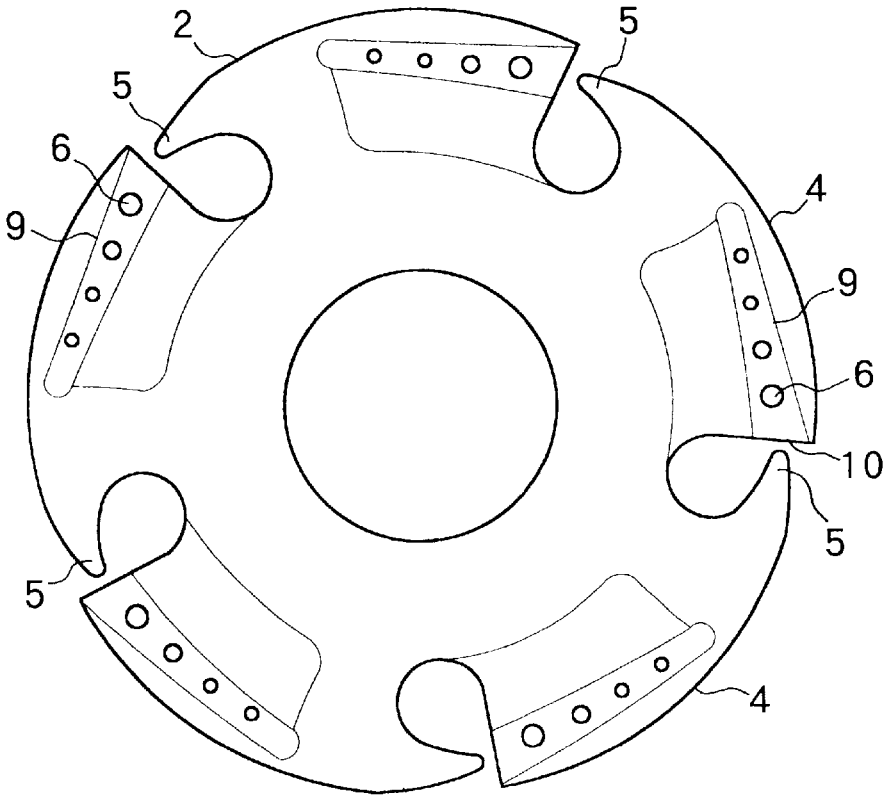
FIG. 6 is a plan view showing a lower surface of the lower disc.

The rotary type sheet counter disc comprises an upper disc shown in FIGS. 1, 4 and 5, and a lower disc shown in FIGS. 1, 4 and 6. The upper disc 1 and the lower disc 2 are formed respectively of metal discs which have the generally same diameter and a generally elliptical configuration. The upper disc 1 is intimately placed upon the lower disc 2. The upper and lower discs 1 and 2 are rotatable about a shaft 3 in unison. For assembling, the shaft 3 is pierced into shaft holes 28 formed in the centers of the upper and lower discs 1 and 2 (see FIGS. 1 and 2) and tightened by a nut threadingly engaged with one end of the shaft 3.

As shown in FIGS. 4 and 6, the lower disc 2 has a plurality of sheet suction fins 4 equally spacedly arranged on the peripheral edge portion in its circumferential direction. The width of each fin 4 is generally the same. Specifically, the lower disc 2 has five sheet suction fins 4 which equally divide the peripheral edge portion of the lower disc 2 in its circumferential direction.

Each sheet suction fin 4 has a sheet loosening claw 5 continuous with and projecting from one end (leading end in the rotating direction of the lower disc 2) thereof. The shape of each sheet loosening claw 5 is generally the same.

Accordingly, the sheet loosening claws 5 are equally spacedly arranged on the peripheral edge portion of the lower disc 2. This means that the lower disc 2 has the same number of the sheet loosening fins 5 as the sheet suction fins 4. The sheet loosening fins 5 are arranged at locations where the fins 5 can divide the peripheral edge portion of the lower disc 2 into five equal parts in the circumferential direction.

Figure 7:
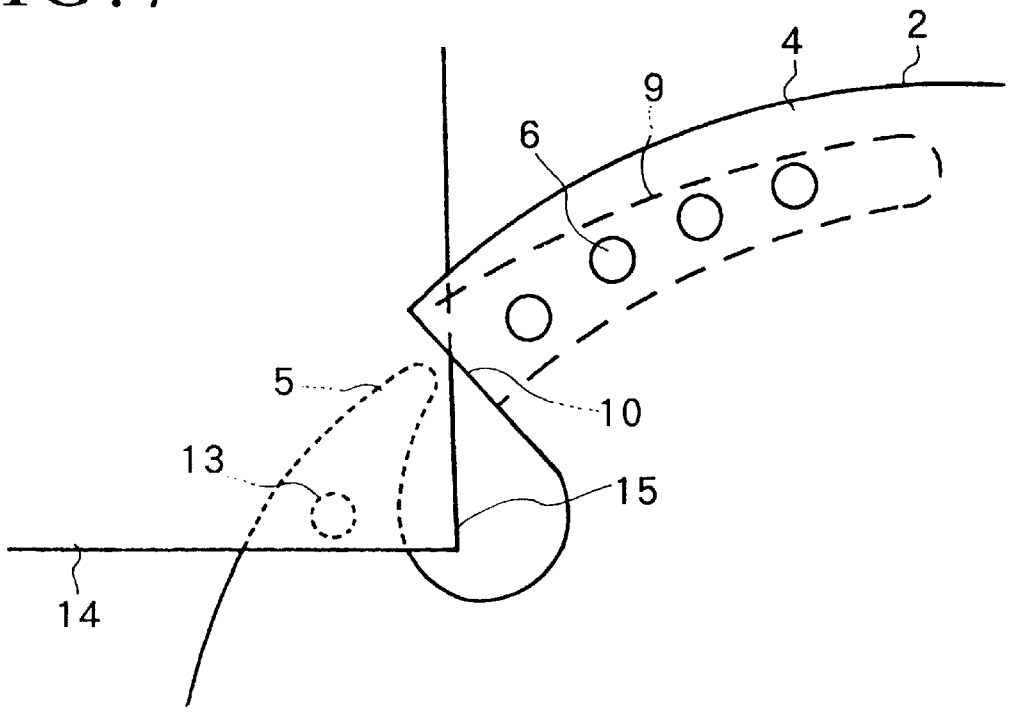
FIG. 7 is a plan view showing a sheet loosening claw and a sheet suction fin disposed on the lower disc on an enlarged scale.

As shown in FIGS. 6 and 7, each sheet suction fin 4 is provided at its lower surface with a single or a plurality of sheet suction ports 6 for sucking up an upper surface of a comer portion of each stacked-up sheet. In operation, the comer portion of each stacked-up sheet is sucked up by the sheet suction ports 6, and the following sheet loosening claw 5 is inserted between a lower surface of the corner portion of the sheet thus sucked up and a top surface of the next top sheet.

In other words, the sheet loosening claw 5, which is located opposite a reversed end portion of each fin 4 with respect to its rotating direction, is inserted between the lower surface of the sheet sucked up by the sheet suction fin 4 and the top surface of the next top sheet.

Figure 8:
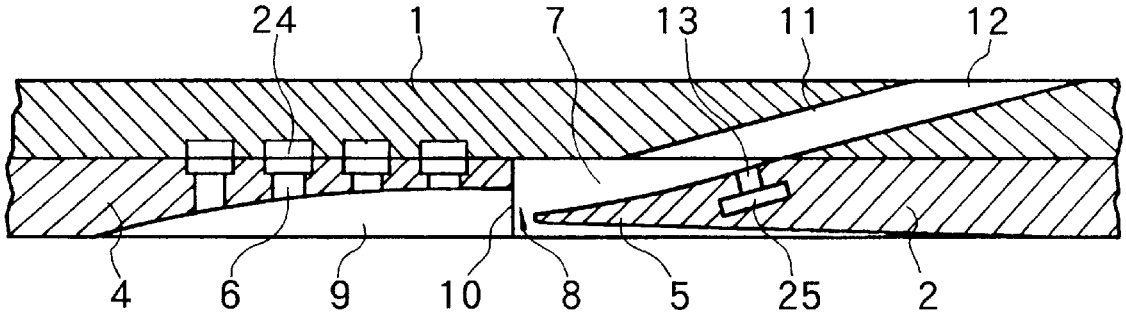
FIG. 8 is a sectional view of FIG. 7.

As shown in FIG. 8, a sheet introduction slit 7 is formed between an upper surface of the sheet loosening claw 5 and a lower surface of the peripheral portion of the upper disc 2 which covers the sheet loosening claw 5. The sheet introduction slit 7 is open at a distal end portion of the sheet loosening claw 5, and a sheet introduction port 8 is formed by the opening portion. In other words, the sheet introduction port 8 is formed between the distal end portion of each sheet loosening claw 5 and an end portion of each sheet suction fin 4 adjacent thereto in its rotating direction.

Accordingly, each sheet introduction slit 7 is open outwardly of the diameter of the disc at an outer edge portion of each sheet loosening claw 5 and also open inwardly of disc diameter through the sheet introduction port 8.

As a consequence, the corner portion of each sheet sucked up by the sheet suction ports 6 formed in the lower surface of each sheet suction fin 4 is introduced into each sheet introduction slit 7 through each sheet introduction port 8 and taken up by each sheet loosening claw 5 inserted under the lower surface of the corner portion of each sheet.

One good example is shown in FIGS. 7 and 8. A sheet releasing groove 9 is formed in a lower surface of each sheet suction fin 4 such that the groove 9 extends in the rotating direction. A plurality of the sheet suction ports 6 arranged in side by side relation in the rotating direction are open at an inner bottom surface of the sheet releasing groove 9. An end opening portion 10 of the sheet releasing groove 9 faces a distal end of the sheet loosening claw 5. That is, the distal end portion of the sheet loosening claw 5 is situated within a range of the thickness of the sheet suction fin 4 which is adjacent thereto in the rotating direction and faces the end opening portion 10 of the sheet releasing groove 9.

On the other hand, a plurality of outlet slits 11 are equally spacedly formed in the peripheral edge portion of the upper disc 1. As one concrete example, the sheet outlet slits 11 are formed such that they divide the peripheral edge portion of the upper disc 1 into five equal parts. Each sheet outlet slit 11 is in communication with each sheet inlet slit 7 at the overlapping portion between the upper and lower discs 1 and 2 and has a sheet outlet port 12 which is open at the upper surface of the upper disc 1.

The sheet corner portion introduced into the sheet introduction slit 7 by the sheet loosening claw 5 is introduced into the sheet outlet slit 11 and taken up and supported on the upper surface of the upper disc 1 through the sheet outlet port 12. In case the rotary type sheet counter disc has the sheet suction fins and the sheet loosening claws at those locations for dividing the peripheral edge portion of the counter disc, five sheet comer portions are taken up and supported on the upper surface of the upper disc 1 in accordance with rotation of the rotary type sheet counter disc.

Each sheet introduction slit 7 and each sheet outlet slit 11 communicating with the slit 7 extend in the opposite direction with respect to the rotating direction of the disc at an upwardly inclining angle. Owing to this arrangement, the sheet corner portion introduced into the sheet introduction port 8 can reliably be introduced into the sheet introduction slit 7 and the sheet outlet slit 11 and smoothly be output from the sheet outlet port 12 in accordance with rotation of the rotary type sheet counter disc.

The sheet introduction slit 7 or the sheet outlet slit 11 is provided at its inner surface with a sheet suction port 13 for generating a sheet counting signal. As one example, the sheet suction port 13 is open in the neighborhood of the basal portion of the sheet loosening claw 5, in other words, at an upper surface (inner surface) of the connecting portion between the sheet loosening claw 5 and the sheet suction fin 4 as shown in FIGS. 4 and 8.

Accordingly, the sheet corner portion is introduced, while being loosened by the sheet loosening claw 5, into the sheet introduction slit 7 and sucked by the sheet suction port 13. The sheet is counted when the sheet suction port 13 sucks the lower surface of the sheet corner portion.

The sheet counter disc is lowered while rotating, with the lower surface of its peripheral edge portion, i.e., the lower surface of the peripheral edge portion of the lower disc 2 loaded on the upper surface of the sheet stack 14, and gradually takes up the corner portion of each sheet 15 onto the upper surface of the upper disc 1 from the top sheet to the bottom sheet.

Figure 2:
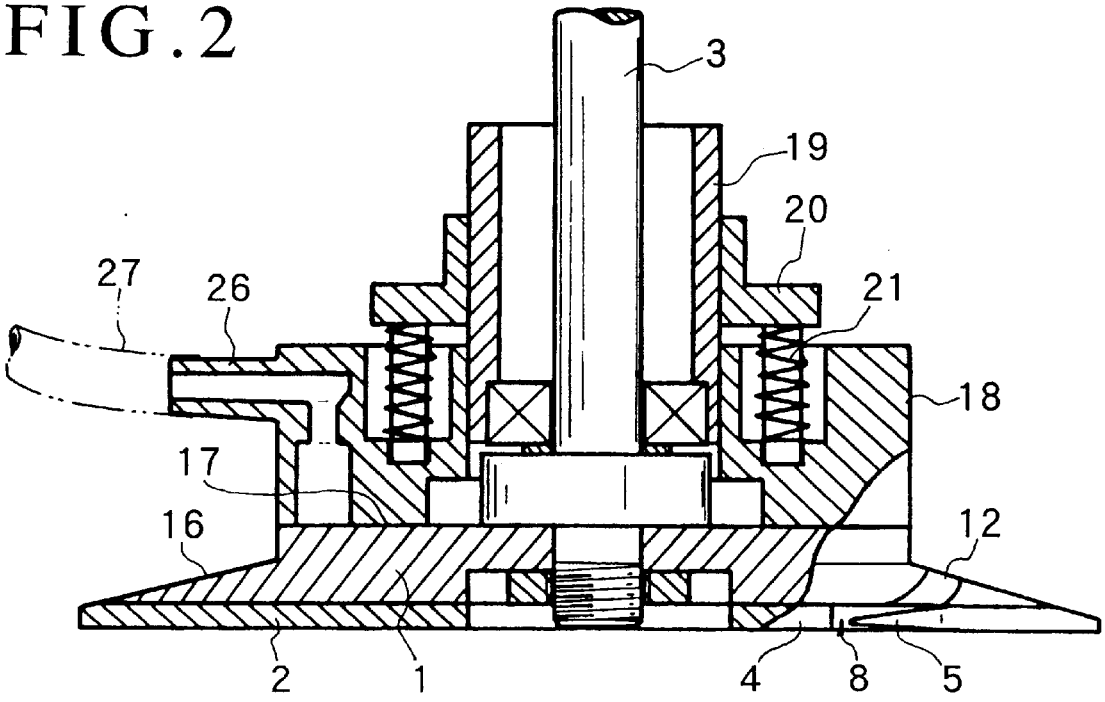
FIG. 2 is a sectional view of the sheet counter disc.
Figure 3:
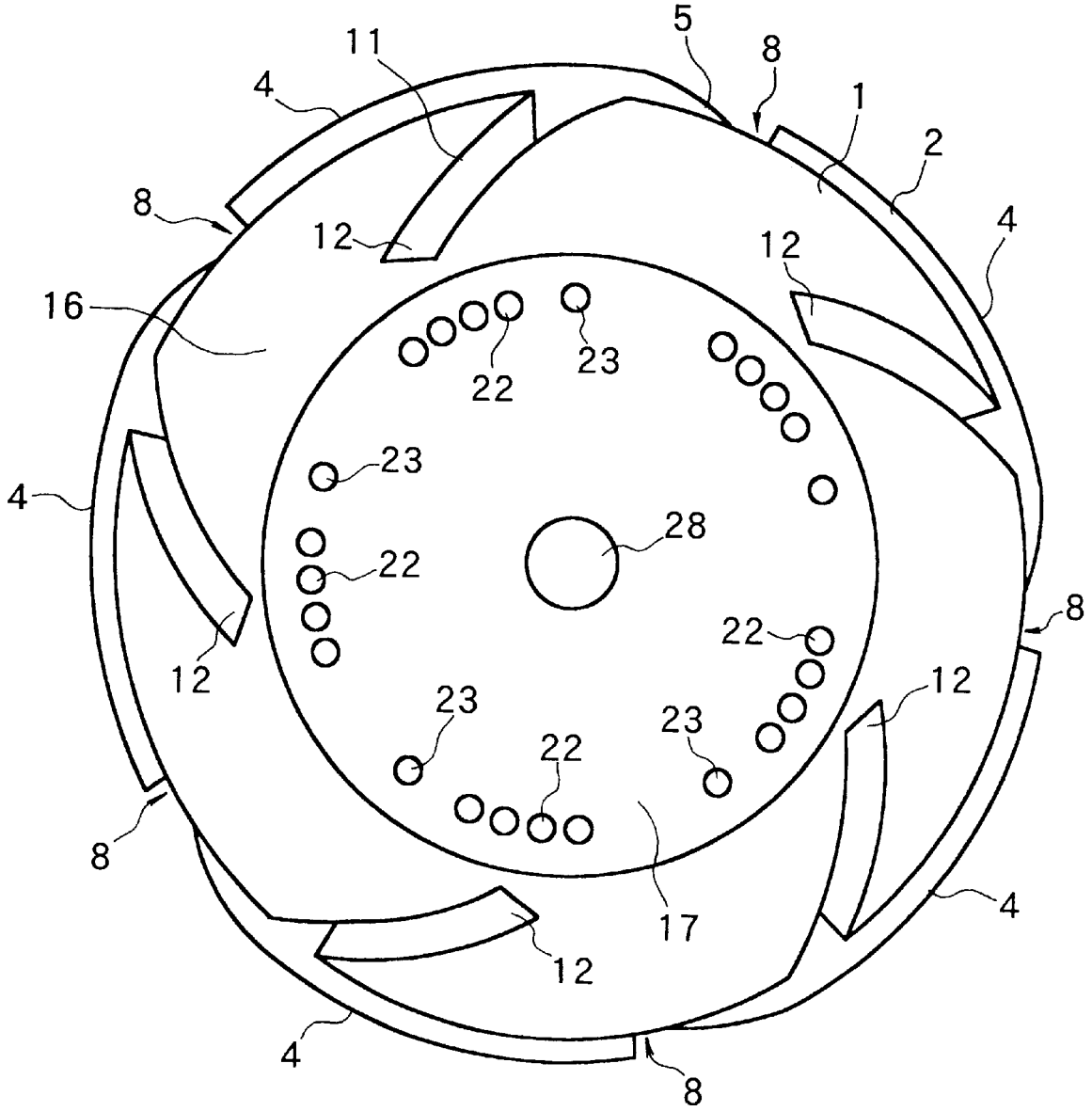
FIG. 3 is a plan view of the sheet counter disc.

As shown in FIGS. 2, 3 and 5, the upper surface of the outer peripheral edge portion of the upper disc 1 defines an annular inclination surface 16 having an upwardly inclining angle towards the central portion, so that the sheet corner portion can smoothly be taken up.

A central area of the upper disc is a circular planar surface 17, i.e., a circular planar surface 17 perpendicular to the shaft 3. A circular air chamber 18 is intimately adhered to this circular planar surface 17. As shown in FIG. 2, the air chamber 18 is connected to a suction source through a connection port 26 and an air hose 27 connected to the connection port 26. The air chamber 18 is disposed about the shaft 3 and fixed so as not to rotate together with the shaft 3 and the upper and lower discs 1 and 2.

For example, an outer sleeve 19 is loosely fitted onto the shaft 3 and non-rotatably secured to a frame. The air chamber 18 is fitted onto an outer peripheral surface of this outer sleeve 19. The outer sleeve 19 is provided with a flange 20. Springs 21 are interposed between the flange 20 and the upper disc 1. A lower surface of the air chamber 18 is urged against the circular planar surface 17 of the upper disc 1 by a biasing force of the springs 21.

Accordingly, the lower surface of the air chamber 18 and the circular planar surface 17 are intimately adhered together. An air vacuum is applied from the air chamber 18 to the disc at this intimately adhered surface.

The upper disc 1 is provided with a plurality of air suction ports 22 communicating with the sheet suction ports 6, respectively, and a plurality of air suction ports 23 communicating with the sheet suction ports 13, respectively. First ends of the air suction ports 22 and 23 are open at the circular planar surface 17 of the central portion of the upper disc 1.

The second ends of the air suction ports 22 and 23 pierce through the upper disc 1 in its thickness direction and are open at the overlapping surface of the disc 1 so as to communicate with the sheet suction ports 6 and 13.

The air chamber 18 periodically provides air suction force to the air suction ports 22 and 23 and sheet suction force to the sheet suction ports 6 and 13 in accordance with rotation of the disc.

More specifically, as shown in FIG. 4, the upper and lower discs 1 and 2 are provided with a plurality of radially extending air passages 24. Those air passages 24 are formed in the inner surfaces of the upper and lower discs 1 and 2, i.e., the overlapping surface between the upper and lower discs 1 and 2. Outer ends of the air passages 24 are in communication with the sheet suction ports 6, while inner ends thereof are in communication with the air suction ports 22. The air passages 24 are closed at the overlapping surface between the upper and lower discs 1 and 2 to thereby form air-tight passages. The sheet suction ports 6 are communicated with the air suction ports 22 through the air passages 24.

The lower disc 2 is provided with a plurality of radially extending air passages 25. Outer ends of the air passages 25 are in communication with the sheet suction ports 13, while inner ends thereof are in communication with the air suction ports 23. The sheet suction ports 13 are communicated with the air suction ports 23 through the air passages 25.

In the illustrated example, the air passages 24 are formed by closing the grooves formed in the overlapping surface between the upper and lower discs 1 and 2, and the air passages 25 generally radially extend through the thickness of the lower disc 2.

Operation of the sheet counter disc will now be described with reference to FIGS. 9 through 13 in order to make apparent the construction of the present invention.

Figure 9:
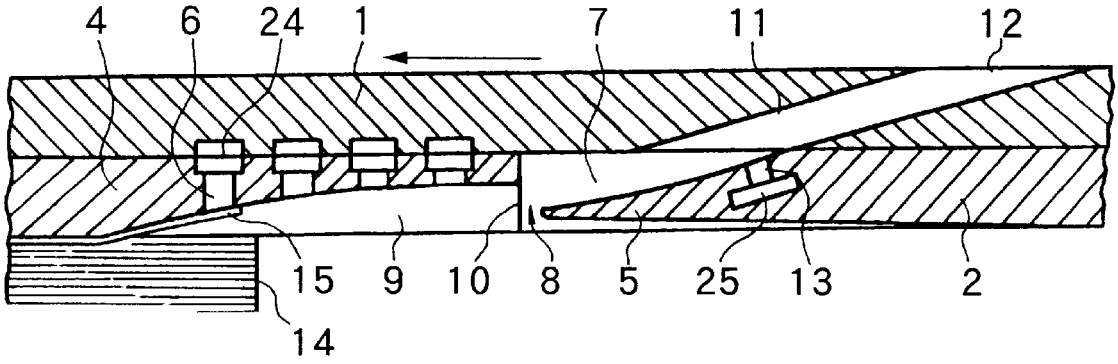
FIG. 9 is a sectional view of a main portion showing a first portion of a sheet take-up process carried out carried out with respect to a sheet corner portion by a sheet counter disc.
Figure 10A:
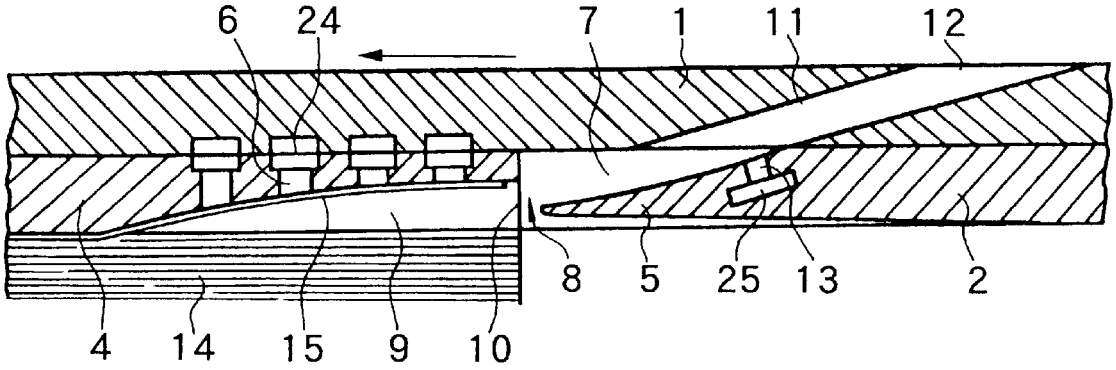
FIG. 10(A) is a sectional view of a main portion showing a second portion of the sheet take-up process carried out with respect to a sheet corner portion by the sheet counter disc.
Figure 10B:
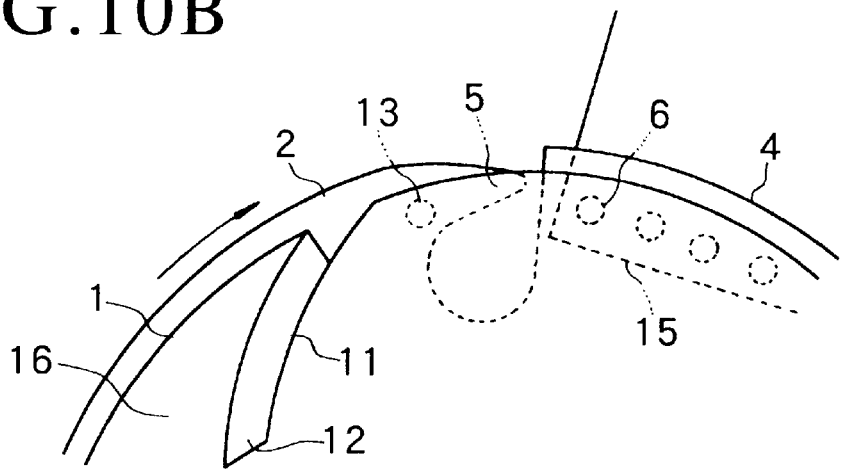
FIG. 10(B) is a plan view thereof.

As shown in FIGS. 9, 10(A) and 10(B), the upper surface of the sheet comer portion is sucked up by the suction ports 6 of a single suction fin 4 in accordance with rotation of the sheet counter disc.

Figure 11:
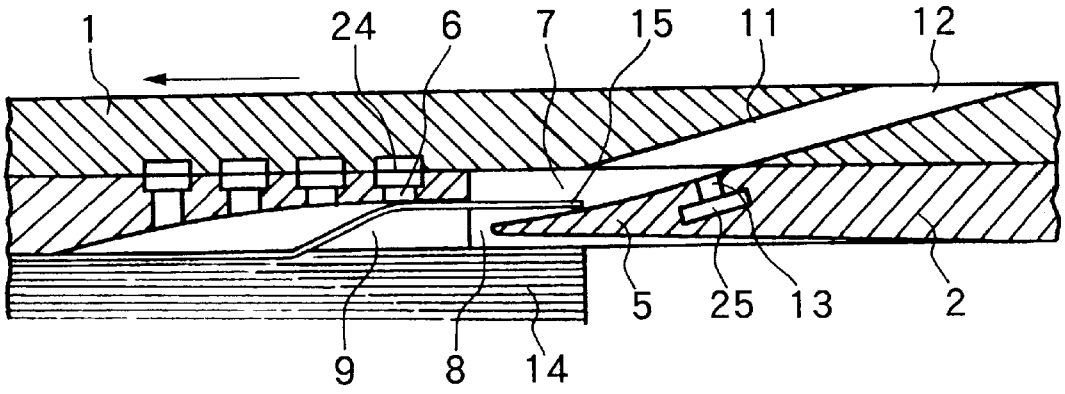
FIG. 11 is a sectional view of a main portion showing a third portion of the sheet take-up process carried out with respect to a sheet corner portion by the sheet counter disc.
Figure 12A:
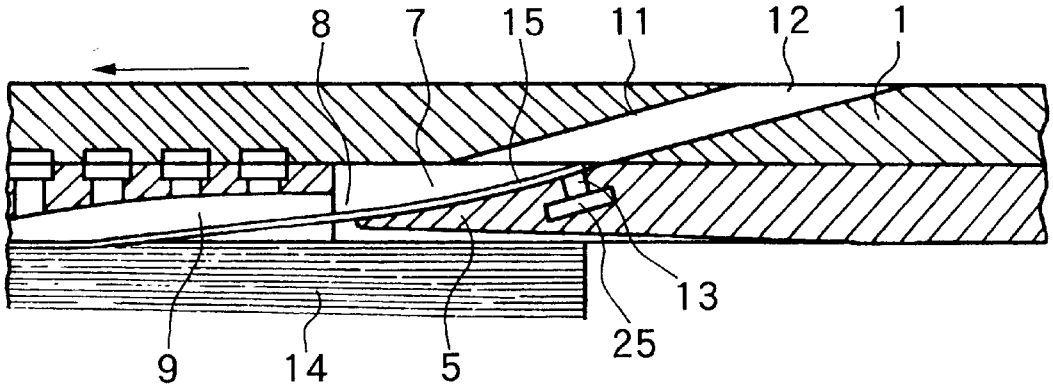
FIG. 12(A) is a sectional view of a main portion showing a fourth portion of the sheet take-up process carried out with respect to a sheet comer portion by the sheet counter disc.
Figure 12B:
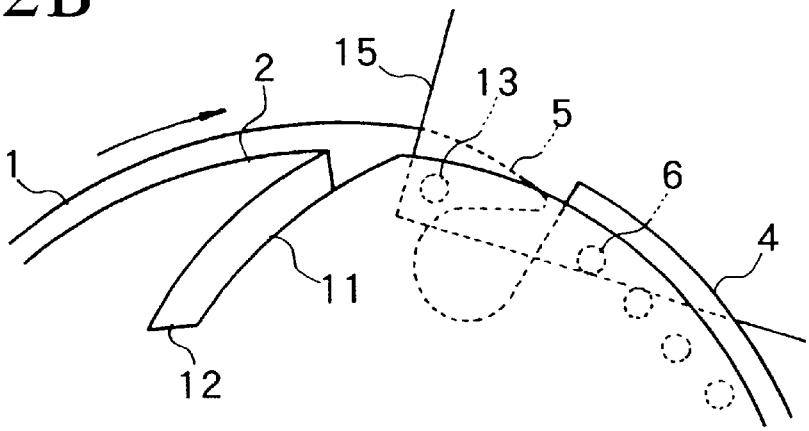
FIG. 12(B) is a plan view thereof.

As shown in FIGS. 11, 12(A) and 12(B), in accordance with further rotation of the sheet counter disc, the sheet loosening claw 5 is inserted under the lower surface of the sheet corner portion sucked up by the sheet suction fin 4 so as to introduce the sheet into the sheet slit 7. Thus, the sheet comer portion sucked up by the sheet suction fin 4 is taken up by the sheet loosening claw 5.

Figure 13A:
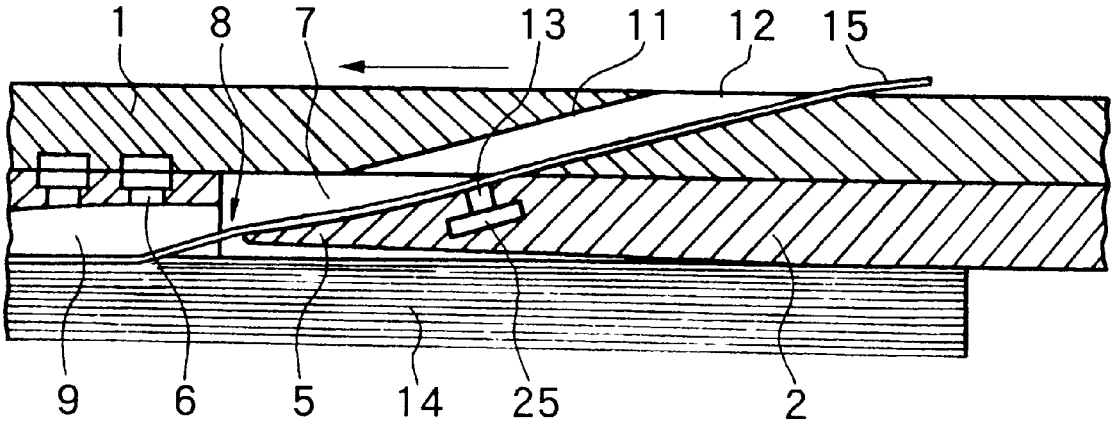
FIG. 13(A) is a sectional view of a main portion showing a fifth portion of the sheet take-up process carried out with respect to a sheet corner portion by the sheet counter disc.
Figure 13B:
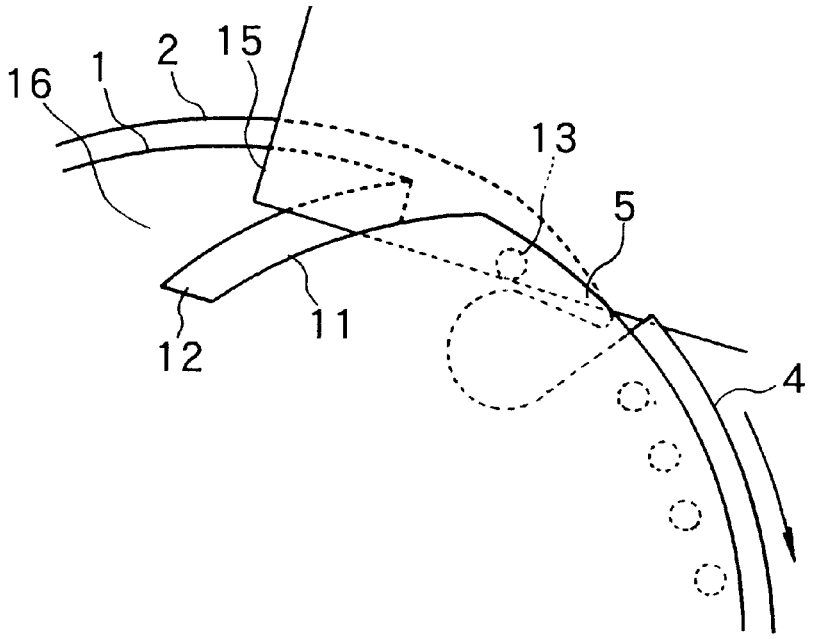
FIG. 13(B) is a plan view thereof.

Then, as shown in FIGS. 13(A) and 13(B), in accordance with rotation of the disc, the sheet comer portion introduced into the sheet introduction slit 7 is guided into the sheet outlet slit 11 and taken up onto the upper surface, i.e., the annular inclining surface 16, of the upper disc 1 through the sheet outlet port 12.

The above-mentioned operation is repeated in accordance with rotation of the disc, and the corner portion of each sheet 15 of the stacked-up sheets 14 is gradually taken up from the top sheet to the bottom sheet so as to be supported on the upper surface of the upper disc 1.

The sheet corner portion introduced into the sheet introduction slit 7 is caused to be drawn against and to close the sheet suction port 13, thereby outputting a sheet counting signal so that the number of the sheets taken up by the sheet loosening claw 5 can be counted.

The sheet counter disc comprising the upper disc and the lower disc can effectively be applied to a device for counting the number of sheets or as a device for separating a predetermined number of sheets from the stacked-up sheets by gradually taking up the comer portions of the stacked-up sheets from the top sheet to the bottom sheet in accordance with its rotation.

The rotary type sheet counter disc according to the present invention can perform the work for gradually taking up the corner portions of the stacked-up sheets and counting the number of them at a high speed. Moreover, the work for taking up the comer portions of the stacked-up sheets can reliably be preformed under high speed rotation. In addition, the purpose for counting the number of the sheets can efficiently be achieved.

It is to be understood that the form of the invention herewith shown and described is to be taken as the preferred embodiment of the same, and that various changes in the shape, size and arrangement of parts may be resorted to without departing from the spirit of the invention or the scope of the subjoined claims.

What is claimed is:

1. A construction of a rotary type sheet counter disc for gradually counting corner portions of stacked-up sheets from the top sheet to the bottom sheet, said sheet counter disc comprising an upper disc and a lower disc on which said upper disc is placed, said lower disc having a plurality of sheet suction fins equally spacedly arranged on a peripheral edge portion thereof, said sheet suction fins each having a sheet suction port which is open at a lower surface thereof, said lower disc having a plurality of sheet loosening claws projecting in a rotating direction of said sheet counter disc from leading ends of said sheet suction fins, a plurality of sheet introduction slits being formed between upper surfaces of said sheet loosening claws and a lower surface of a portion of said upper disc which covers said sheet loosening claws, said sheet introduction slits each having a sheet introduction port opening at a distal end portion of each sheet loosening claw, said upper disc having a plurality of sheet outlet slits equally spacedly arranged on a peripheral edge portion thereof, said sheet outlet slits each having a sheet outlet port communicating with each sheet introduction slit and opening at an upper surface of said upper disc, said sheet suction fins each sucking up an upper surface of each stacked-up sheet, said sheet loosening claws each being inserted under and taking up a lower surface of a corner portion of each such sucked-up sheet so as to introduce the same into each sheet introduction slit through each sheet introduction port, the sheet corner portion introduced into said sheet introduction sheet being introduced into said sheet outlet slit and taken up onto the upper surface of said upper disc through said sheet outlet port.

2. A construction of a rotary type sheet counter disc according to claim 1, wherein said sheet counter disc is supported such that said sheet counter disc is capable of rotation while being lowered in a state that said sheet counter disc is loaded on the upper surface of the corner portion of said stacked-up sheets.

3. A construction of a rotary type sheet counter disc according to claim 1, wherein said sheet introduction slits or said sheet outlet slits are each provided in an inner surface thereof with a sheet suction port for generating a sheet counting signal.

4. A construction of a rotary type sheet counter disc according to claim 1, wherein said sheet suction fins are each provided in a lower surface thereof with a sheet releasing groove extending in the rotating direction, an end opening portion of said sheet releasing groove faces a distal end of said sheet loosening claw, and a plurality of said sheet suction ports are open at an inner bottom surface of said sheet releasing groove.

5. A construction of a rotary type sheet counter disc according to claim 1, wherein said sheet introduction slits and said sheet outlet slits extend in an opposite direction with respect to the rotating direction of said sheet counter disc at an upwardly inclining angle.

* * * * *